United States Patent [19]

Shubow

[11] Patent Number: 4,461,130

[45] Date of Patent: Jul. 24, 1984

[54] BUILDING CONSTRUCTION USING HOLLOW CORE WALL SLABS

[76] Inventor: Calvin Shubow, 30995 Hunter's Dr., Farmington, Mich. 48024

[21] Appl. No.: 268,598

[22] Filed: May 29, 1981

[51] Int. Cl.[3] ..... E04H 1/00

[52] U.S. Cl. ..... 52/236.8; 52/236.6; 52/259

[58] Field of Search ..... 52/236.6, 236.7, 236.8, 52/236.9, 251, 262, 302, 259, 441, 442, 421, 436

[56] References Cited

U.S. PATENT DOCUMENTS

| | | | |
|---|---|---|---|
| 1,501,288 | 7/1924 | Morley | 52/236.8 |
| 1,757,077 | 5/1930 | Eiserloh | 52/262 |
| 2,883,852 | 4/1959 | Midby | 52/236.8 |
| 3,423,891 | 1/1969 | Burris | 52/262 |
| 3,710,527 | 1/1973 | Farebrother . | |
| 3,719,016 | 3/1973 | Randolph . | |
| 3,950,902 | 4/1976 | Stout | 52/262 |
| 4,010,581 | 3/1977 | Keturi et al. . | |
| 4,018,021 | 4/1977 | Dow | 52/251 |
| 4,098,042 | 7/1978 | Sachs et al. . | |
| 4,127,971 | 12/1978 | Rojo | 52/262 |
| 4,231,199 | 11/1980 | Comez | 52/251 |

FOREIGN PATENT DOCUMENTS

| | | | |
|---|---|---|---|
| 1249492 | 9/1967 | Fed. Rep. of Germany | 52/236.6 |
| 2728911 | 2/1978 | Fed. Rep. of Germany | 52/236.8 |

*Primary Examiner*—Henry E. Raduazo

*Attorney, Agent, or Firm*—Krass and Young

[57] ABSTRACT

A concrete bond beam is employed in building constructions using concrete slabs having hollow core channels therein serving as vertical walls. The bond beam includes at least one opening therein and a pair of downwardly extending flanges. The bond beam is mounted on top of each slab with the top edges of the slabs being received between the flanges of the bond beam so that the opening therein is aligned with a selected core channel in the slab. Reinforcement rods extend both horizontally within the confines of the bond beam and vertically through the cores in the wall slabs and the openings in the bond beam. Structural concrete columns are formed in the wall slab cores surrounding the vertical reinforcement rods. The building thus contains a matrix of structural reinforced concrete beams running both horizontally and vertically throughout the construction.

3 Claims, 6 Drawing Figures

BUILDING CONSTRUCTION USING HOLLOW CORE WALL SLABS

BACKGROUND OF THE INVENTION

This invention relates to building constructions and, more particularly, to building constructions utilizing precast concrete slabs with hollow core channels.

Precast concrete slabs with hollow core channels are often used as floors in multistory buildings. The hollow cores are designed to provide passageways for utility cables and the like. The cored slabs are relatively inexpensive and readily available from a variety of sources. The prior art has contemplated using these cored slabs as both the floor panels and upstanding walls for a building. Such a construction is shown in U.S. Pat. No. 4,010,581 to Kenturi et al. In that patent the cores are used for routing utility cables through the building. U.S. Pat. No. 3,710,527 to Farebrother illustrates the use of the core channels to hold vertical reinforcement rods extending the entire height of the building.

Those skilled in the art will appreciate that the joining together of the structure walls and floors is one of the most important procedures in building a rigid, structurally sound multistory building. Unfortunately, it is also one of the most time consuming and expensive steps both in terms of labor and material costs. A reading of the above-mentioned patents illustrate that great care must be taken to insure that these joints are made properly. In the Kenturi et al patent additional vertical openings must be formed in the floor slabs to permit communication between the cores in the vertical wall slabs. Farebrother's floor slabs must be provided with specially formed castellated ends which interlock at the joints.

The structural soundness of a multistory building is, of course, of primary concern. Reinforcement rods have been used in the past as one means for increasing the rigidity of the resultant structure. Some prefabricated concrete slabs have reinforcement rods embedded in them during fabrication. These slabs are often designed for specific uses and do not readily lend themselves to multi-purpose applications such as the use of the slabs for walls as well as the floors.

OBJECTS AND SUMMARY OF THE INVENTION

It is an object of this invention to provide an extremely rigid multistory building construction using precast concrete slabs with hollow core channels.

It is a further object of this invention to provide such a building construction at relatively low cost both in terms of labor and material costs.

The building utilizes precast concrete slabs for both walls and floors. At least the wall slabs include a plurality of vertically extending core channels. A bond beam is employed at the joints between the walls and floors and is adapted to readily direct the grid of reinforcement rods through the joints in an effective manner. The bond beam includes at least one opening therethrough and a pair of downwardly extending flanges. The bond beam is mounted so as to receive the top edges of the wall slabs between the flanges and align the opening in the bond beam with a selected core channel. The floor slabs are adapted to rest on an upper surface of the bond beam yet leave a vertical path from the opening unobstructed. At least one horizontally extending reinforcing rod passes within the confines of the bond beam. Vertically extending reinforcement rods pass through the cores in the wall slabs and openings in the bond beam. The vertically extending reinforcement rods extend upwardly beyond the floor panels and are adapted to be connected to a rod in a similarly constructed wall slab for an upper story. A concrete column in the wall slab core surrounding the vertical reinforcement rods may be provided by pouring concrete through the bond beam opening into the core. The horizontally extending reinforcement rods are also encompassed by concrete. In one embodiment, the bond beam is generally H-shaped with an upwardly extending trough which may be filled with concrete to surround the horizontal rods laid in the trough. In another embodiment, the horizontal reinforcement rods are precast integral with the bond beam.

In such manner the multistory building construction can be made both structurally sound and at minimal costs, with a relatively few number of steps being required to construct the otherwise complex joint.

BRIEF DESCRIPTION OF THE DRAWINGS

These and other objects and advantages of the present invention will become apparent to one skilled in the art after reading the following specification and by reference to the drawings which.

DESCRIPTION OF THE PREFERRED EMBODIMENT

Figure 1:
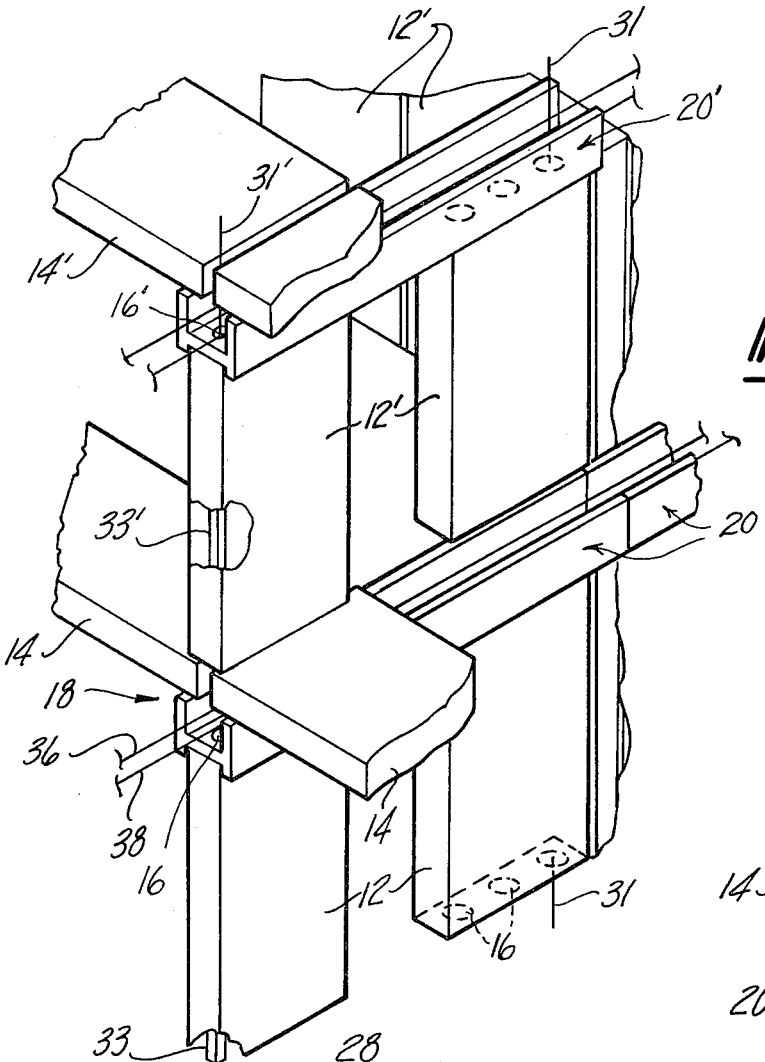
FIG. 1 is a perspective view with parts cut away of a multistory building construction made in accordance with the present invention.

FIG. 1 shows a multistory building 10 having a plurality of vertical wall members formed by slabs 12 and horizontal floor members formed of slabs 14, which one will recognize also serve as ceilings for the upper story in which common components will be designated with a primed reference numeral. Slabs 12 and 14 are made of precast concrete. Wall slabs 12 include a plurality of vertically extending core channels 16 which extend from the top edge to the bottom edge thereof as can be seen most clearly in FIGS. 2 and 3. The interconnection between the floor slabs and the wall slabs of adjacent stories are joined together at a joint generally designated by the numeral 18.

Joint 18 employs a horizontally extending bond beam 20. In the embodiment shown in FIGS. 1–5 bond beam 20 incorporates a generally H-shaped lintel beam 22 made of precast concrete. Lintel beam 22 includes two spaced downwardly extending flanges 24 and 26 which are operative to receive the upper edges of wall slabs 12. Lintel beam 22 may be made of a variety of lengths but, preferably, is of sufficient length to bridge at least two adjacent wall slabs 12 as can be seen in FIG. 1. Wall slabs 12 in the front of FIG. 1 are spaced apart to provide a doorway. However, it should be realized that wall slabs 12 will be in abutting relationship in many applications as can be seen in the rearward portion of FIG. 1. Lintel beam 22 includes a web portion 28 having one or more openings 30. Lintel beam 22 is mounted on the top edges of wall slab 12 such that openings 30 align with preselected cores 16 in wall slab 12. Vertically extending reinforcement rods 31 are encompassed in structural concrete columns 33 which fill cores 16 and opening 30.

Upwardly extending flanges 32, 34 of lintel beam 22 define a trough for receiving horizontally extending reinforcement rods 36, 38. The trough in lintel beam 22 is filled with concrete 40 to encompass rods 36, 38.

Horizontally adjacent floor slabs 14 rest on the upper surface of lintel beam 22. The opposite edges of floor slabs 14 are, however, spaced from each other so as to leave an unobstructed path vertically extending from openings 30 to permit rods 31 to pass freely. The space between the edges of floor slabs 14 are filled with a suitable cement grout 42.

The upwardly extending projection of vertical reinforcement rods 31 pass into cores 16' of similarly constructed slabs 12' and may be connected via ties 44 to other vertically extending rods 31'. These rods 31' are similarly enclosed in vertically extending columns of structural concrete 33' filling cores 30'.

Figure 4:
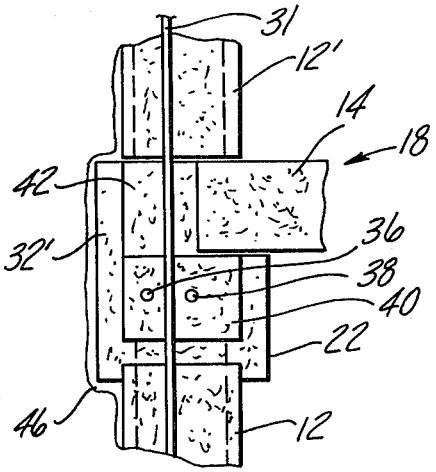
FIG. 4 is a cross-sectional view of a joint at an outer extremity of a building.
Figure 5:
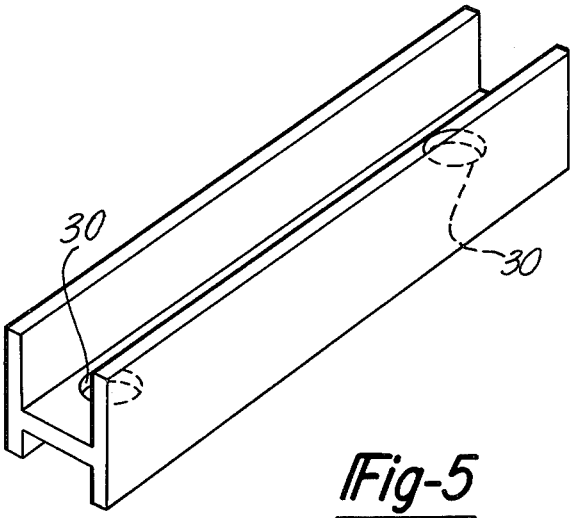
FIG. 5 is a perspective view of one embodiment of a bond beam made in accordance with this invention.

FIG. 4 shows a modification of lintel beam 22 which can be used, for example, at the outer extremity of the building. Since the joint 18 need only connect floor slab 14 in one direction, the outer most upwardly extending flange 32' is much higher and serves as a faceplate enclosing the internal floor slab 14. The outer faces of wall slabs 12 and lintel beam 22 can be covered with a decorative coating 46 to provide an aesthetically pleasing appearance for the building.

Figure 6:
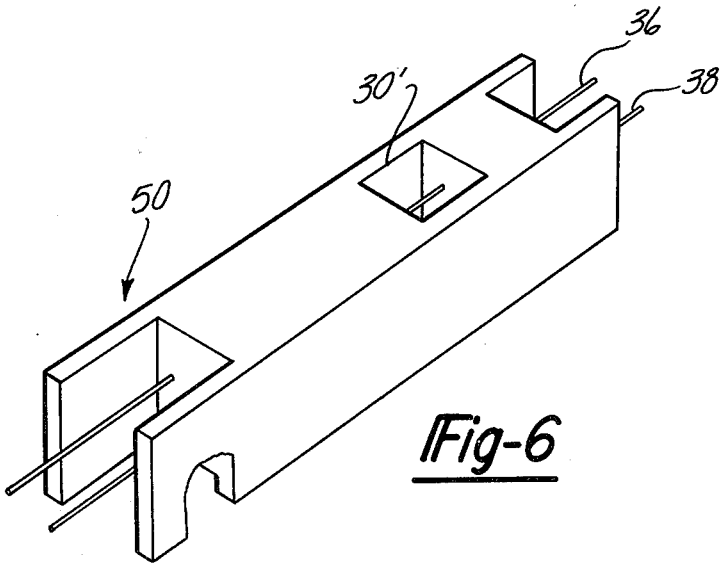
FIG. 6 is a perspective view with a portion cut away of alternative embodiment of a bond beam.

The combination of the lintel beam 22 and reinforced concrete 40 with rods 36, 38 embeded therein can be envisioned as a bond beam. In the embodiment shown in FIG. 6 the bond beam is a unitary structure. Bond beam 50 is a generally rectangular solid device made of concrete in which reinforcement rods 36, 38 are precast into it. In this embodiment opening 30 is shown as being square as compared to a circular shape as in the previous embodiment. In all other respects, bond beam 50 generally corresponds with the previous embodiments.

The building 10 of the present invention may be readily constructed as follows. The first floor is erected on a suitable foundation (not shown) with a first course of wall slabs 12 being arranged thereon to define at least the outer structural walls of the building. Preferably, wall slabs 12 are also used to define interior structural walls as well, as shown in FIG. 1. Lintel beams 22 are then laid on the top edges of walls 12 so that they are received within downwardly extending flanges 24, 26 and openings 30 are aligned with selected ones of cores 16. Preferably, lintel beam 22 serves to bridge one or more horizontally adjacent wall slabs 12. In such manner the horizontally adjacent wall slabs 12 are accurately aligned with each other due to the action of flanges 24, 26 of lintel beam 22.

Vertical reinforcing rods 31 are then inserted into the designated cores 16 of the wall panels 12 through openings 30 in lintel beam 22. Rods 31 are of sufficient length so that they extend well beyond the top edge of their respective walls 12 so that they may be inserted into vertically aligned cores 16' of the second story wall panels 12'. For the first story, the reinforcing rods 31 may extend completely through the bottom edge of wall slab 12 and may be conveniently attached to anchors in the foundation.

Horizontally extending rods 36, 38 are then laid in the upwardly extending trough of lintel beams 22. Horizontal rods 36, 38 preferably extend substantially the entire width of building 10 and may be suitably anchored near the ends of the building. Concrete is then poured into the trough of lintel beam 22 and allowed to flow downwardly into cores 16 to form vertically extending columns 33 of concrete surrounding rods 31. The poured concrete fills the trough in lintel beam 22 to similarly encompass horizontally extending reinforcing rods 36, 38. If desired, the rods may be tensioned so that when the concrete sets the vertically extending columns 33 and horizontally extending bond beams 20 will be prestressed to add further rigidity to the building.

Figure 2:
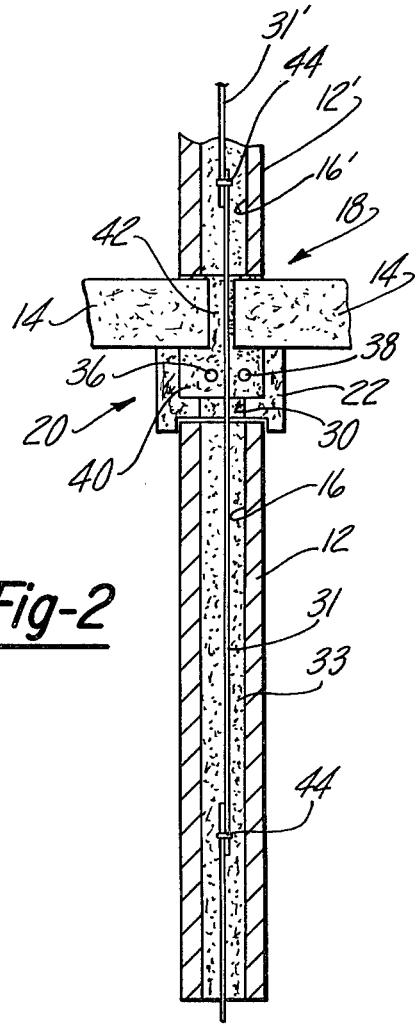
FIG. 2 is a cross-sectional view of a joint between two vertical walls and transverse floor/ceiling slabs.
Figure 3:
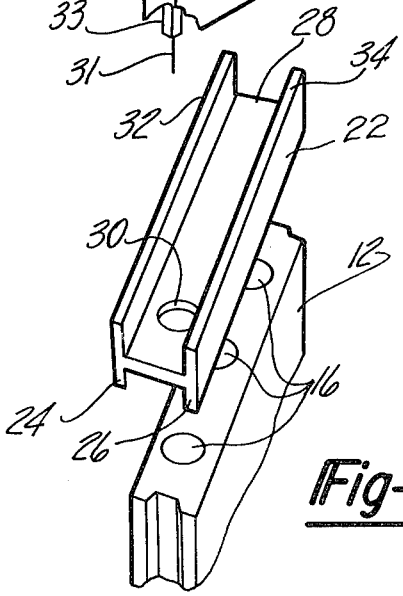
FIG. 3 is a perspective view illustrating one embodiment of a bond beam used in this invention in conjunction with a hollow cored wall slab.

The floor of the second story is erected by resting the edges of floor slabs 14 on the bond beams as shown in FIG. 2. The edges of horizontally adjacent floor slabs 14 are spaced from rods 31 so as to not interfere with them. This space is then filled with cement grout 42.

The second and subsequent stories are constructed in a similar manner. Briefly, second story wall slabs 12' are arranged so that the upward extension of rods 31 are inserted into cores 16' of vertically adjacent wall slabs 12'. The lintel beam 22' is then mounted on the top edges of wall slabs 12' and reinforcement rods 31' are inserted into cores 16'. The lower end of rods 31' and the upper ends of rods 31 may be connected together by ties 44. The horizontal rods 36, 38 are then laid within the trough of lintel beam 22' and the concrete is poured in the manner set forth above. Floor slabs 14' are then mounted on the thus formed bond beam 20' and filled with grout in the spaces between their respective edges.

This process continues for constructing each floor of the building. The ends of the vertical reinforcement rods 31 of the top story may be suitably anchored in the roof structure of the building. It can be appreciated that the resulting building will have a matrix of structurally reinforced concrete beams running vertically and horizontally throughout the construction. The horizontal beams are provided by bond beams 20 and the vertical beams are provided by columns 33. Such a construction provides excellent rigidity for the building and may be provided at comparatively low cost. Those skilled in the art will recognize that readily available cored slabs may be efficiently used as the structural walls for the building and that the joints between the walls and floors are made in a relatively simple manner requiring no excessive labor to specially modify the components to make the otherwise complex joint. Other advantages of the present invention will become apparent after studying the specification, drawings and the following claims.

I claim:

1. In a building construction employing precast concrete slabs having generally parallel core channels extending therethrough from one edge to an opposed edge between opposite faces thereof, the improvement comprising:

a plurality of wall members, each wall member being one of said precast concrete slabs and arranged so that the core channels extend vertically;

a plurality of horizontally extending generally H-shaped precast concrete lintel beams on the top edge of said wall members, said lintel beams each having an upwardly extending trough, a horizontally extending web portion with at least one opening extending vertically therethrough, and a pair of downwardly extending flanges, each lintel beam being arranged so that the top edge of at least one wall member is received between said flanges and said opening is aligned with a selected core channel, at least one horizontally extending reinforcement rod passing within the trough of said lintel beam and encompassed by concrete;

at least one vertically extending reinforcement rod passing through the selected core in the wall member and opening in the lintel beam;

a poured concrete section in the selected core and lintel beam opening surrounding said vertical reinforcement rod; and a floor made of a plurality of precast concrete slab members, each floor member having end faces resting on the upper surfaces of the lintel beams, with edges of the foor members being spaced from a vertical extension of said vertical reinforcement rod whereby said vertical reinforcement rod may be inserted into a selected core of a similarly constructed wall member for an upper story.

2. The improvement of claim 1 wherein said lintel beam is adapted to bridge at least two horizontally adjacent wall members.

3. The improvement of claim 1 wherein one side of the lintel beam extends to a height substantially greater than an opposite side, operative to form a faceplate for an outer extremity of the building which bridges vertically adjacent wall members.

* * * * *